US006883599B2

(12) United States Patent
Yamamoto et al.

(10) Patent No.: US 6,883,599 B2
(45) Date of Patent: Apr. 26, 2005

(54) HEAT EXCHANGER WITH CORRUGATED PLATE

(75) Inventors: Ken Yamamoto, Obu (JP); Takeshi Okinotani, Obu (JP); Norihide Kawachi, Kariya (JP)

(73) Assignee: DENSO Corporation, Kariya (JP)

( * ) Notice: Subject to any disclaimer, the term of this patent is extended or adjusted under 35 U.S.C. 154(b) by 28 days.

(21) Appl. No.: 10/735,687

(22) Filed: Dec. 15, 2003

(65) Prior Publication Data

US 2005/0051311 A1 Mar. 10, 2005

(30) Foreign Application Priority Data

Dec. 20, 2002 (JP) ..... 2002-371127

(51) Int. Cl.[7] ..... F28D 7/16

(52) U.S. Cl. ..... 165/164; 165/140

(58) Field of Search ..... 165/164, 140

(56) References Cited

U.S. PATENT DOCUMENTS

| | | | | |
|---|---|---|---|---|
| 5,462,113 | A * | 10/1995 | Wand | 165/167 |
| 5,884,696 | A * | 3/1999 | Loup | 165/140 |
| 6,009,936 | A * | 1/2000 | Kubota et al. | 165/183 |
| 6,112,806 | A * | 9/2000 | Kawaguchi et al. | 165/164 |
| 6,540,015 | B1 | 4/2003 | Kawachi et al. | |

* cited by examiner

*Primary Examiner*—Paul J. Hirsch
(74) *Attorney, Agent, or Firm*—Harness, Dickey & Pierce, PLC

(57) ABSTRACT

In a heat exchanger for performing heat exchange between a first fluid and a second fluid, a corrugated plate is provided in a first tube defining a first fluid passage through which the first fluid flows. The corrugated plate forms ridges and grooves. Walls between the ridges and grooves include first walls, second walls and third walls. Each first wall defines an opening between its second end and a second side wall of the first tube. Each second wall defines openings at its first and second ends. Each third wall defines an opening between its first end and the first side wall of the first tube. The first to third walls are reiterative in an order of the first wall, the second wall, the third wall and the second wall. Therefore, the first fluid makes double serpentine flows each of which makes alternately large and small turns.

8 Claims, 4 Drawing Sheets

HEAT EXCHANGER WITH CORRUGATED PLATE

CROSS REFERENCE TO RELATED APPLICATION

This application is based on Japanese Patent Application No. 2002-371127 filed on Dec. 20, 2002, the disclosure of which is incorporated herein by reference.

FIELD OF THE INVENTION

The present invention relates to a heat exchanger performing heat exchange between a first fluid and a second fluid. More particularly, the present invention relates to a heat exchanger, which performs heat exchange between a refrigerant and water, for a heat pump type hot-water supply system.

BACKGROUND OF THE INVENTION

Regarding a heat exchanger used in a heat pump hot-water supply system, a refrigerant (e.g. carbon dioxide) is used as heat source for heating water. The heat exchanger needs durability to withstand a high-temperature and high-pressure refrigerant. Recently, to maintain the durability, it is proposed to provide refrigerant passages in a plurality of capillary tubes, such as copper pipes with the diameter approximately a few millimeter, closely arranged in parallel. This kind of heat exchanger is for example disclosed in U.S. Pat. No. 6,540,015 (JP-A-2002-31488).

According to the heat exchanger of U.S. Pat. No. 6,540,015, the capillary tubes are used for defining passages of the high-pressure refrigerant. By this, effective condensation improves because of the small diameter. A passage of the water is formed in a flat box shaped tube that are formed by joining two plates, which are produced by drawing. An inner fin is housed in the box shaped tube and the capillary tubes for the refrigerant are layered on the outer periphery of the box shaped tube. These members are made of steel products, and thereby integrally brazed.

However, the water passage in the tube defines a single flow that serpentines from an inlet to an outlet of the tube. Since the flow of water makes a lot of turns (e.g. about 100 turns), it is likely to increase resistance of the flow of the water.

SUMMARY OF THE INVENTION

The present invention is made in view of the foregoing matter and it is an object of the present invention to provide a heat exchanger capable of reducing resistance of a fluid flow.

According to a heat exchanger of the present invention, a first tube defines therein a first passage through which a first fluid flows and a second tube defines therein a second passage through which a second fluid flows. The second tube is joined to an outer surface of the first tube for performing heat exchange between the first fluid and the second fluid. The first tube defines a first inner side wall and a second inner side wall opposite to each other. The first tube houses a corrugated plate including intermediate walls for partitioning the first fluid passage into a plurality of paths. The intermediate walls of the corrugated plate includes first walls, second walls, and third walls, each having a first end and a second end opposite to each other. Each of the first walls is disposed such that the first end is proximate to the first inner side wall of the first tube and the second end is separate from the second inner side wall of the first tube for defining an opening therebetween. Each of the second walls is disposed such that the first end and the second end are separate from the first inner side wall and the second inner side wall of the first tube for defining openings. Each of the third walls is disposed such that the first end is separate from the first inner side wall of the first tube for defining an opening and the second end is proximate to the second inner sidewall of the first tube. The first walls, the second walls, and the third walls are reiterative in an order of the first wall, the second wall, the third wall, and the second wall.

Accordingly, the inside fluid flows in and out a pair of paths through the openings at the same time and further flows in a subsequent pair of paths through the openings at the same time. The flow of the first fluid makes turns with multiple flows, reducing the number of turns. Preferably, the ends of the intermediate walls are alternately displaced stepwise. Therefore, each of the multiple flows makes alternately large turn and small turn, thereby restricting an increase in resistance of the flows. Further, the first fluid is uniformly distributed to the multiple paths.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

Figure 1:
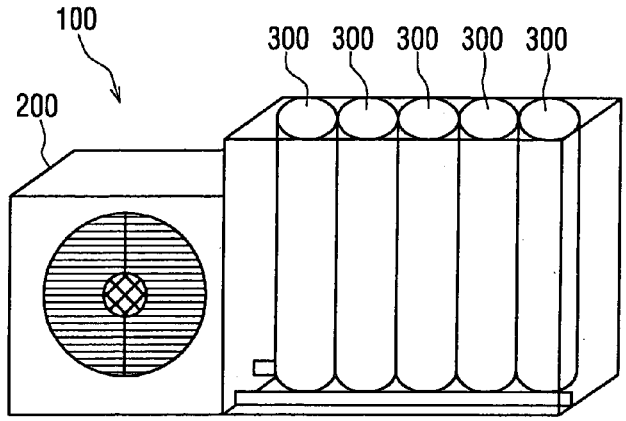
FIG. 1 is a schematic view of a hot water supply system according to the embodiment of the present invention.
Figure 2:
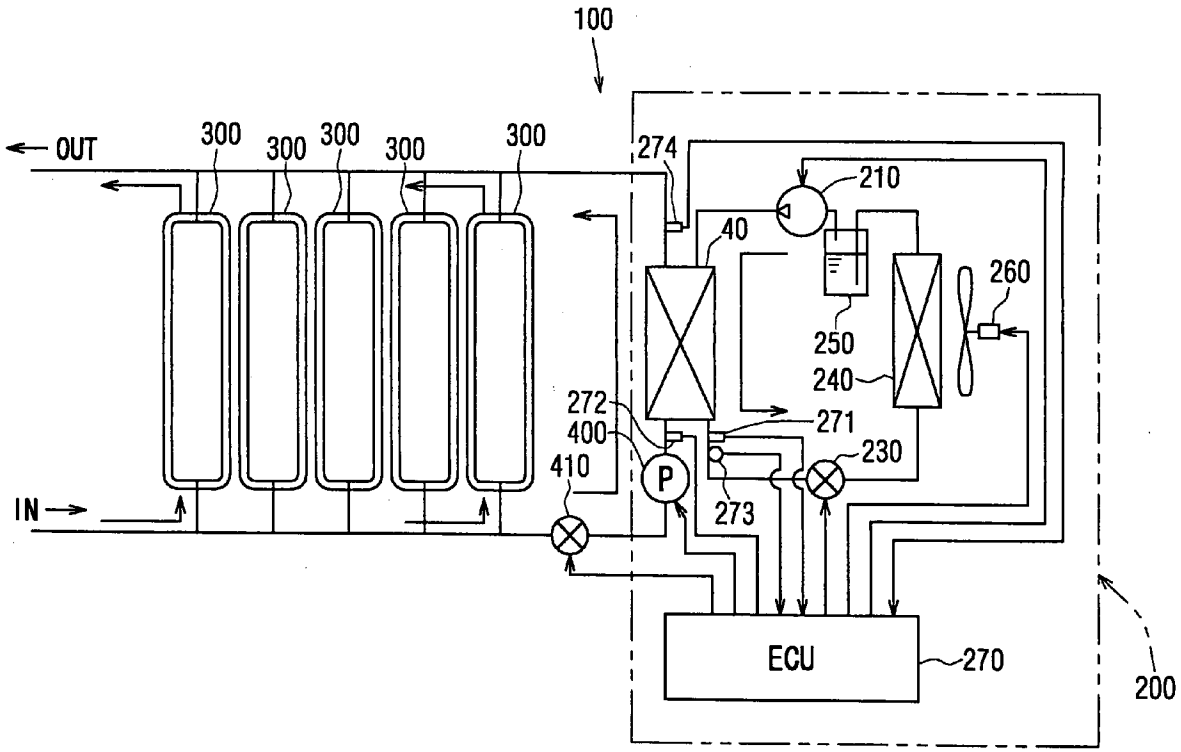
FIG. 2 is a schematic diagram of the hot water supply system according to the embodiment of the present invention.

In the embodiment, a heat exchanger of the present invention is used for a domestic multifunctional hot-water supply system 100 shown in FIGS. 1 and 2. The hot-water supply system 100 includes a super critical heat pump cycle 200, which is surrounded by a chain double-dashed line in FIG. 2, for heating water (service water) to produce hot water with a high temperature (e.g. approximately 85 degrees Celsius in the embodiment).

The super critical heat pump cycle is a heat pump cycle in which the pressure of a refrigerant exceeds a critical pressure at a high pressure side. Hereafter, the super critical heat pump cycle 200 is referred to as a heat pump 200. As an example of the refrigerant for the heat pump, carbon dioxide, ethylene, ethane, or nitrogen oxides is used. In the embodiment, the refrigerant is carbon dioxide. Plural thermal insulation tanks 300 for storing the hot water heated by the heat pump 200 are provided in parallel with respect to a flow of the hot water (hot water to be supplied).

The heat pump 200 has a compressor 210 for sucking and compressing the refrigerant. The compressor 210 is an electric compressor having a compression unit (not shown) for sucking and compressing the refrigerant and an electric motor (not shown) for driving the compression unit. A heat exchanger 40 of the present invention is provided downstream of the compressor 210 with respect to the flow of the refrigerant. The heat exchanger 40 is a water/refrigerant heat exchanger (heat-radiating device) for performing heat exchange between the refrigerant discharged from the compressor 210 and the service water.

An electric expansion valve (pressure-reducing device) 230 is provided downstream of the heat exchanger 40 for decompressing the refrigerant discharging from the heat exchanger 40. An evaporator 240 is provided downstream of the expansion valve 230 for absorbing heat from the atmosphere by evaporation of the refrigerant, which has been discharged from the expansion valve 230. The evaporator 240 discharges the refrigerant toward an accumulator 250 that is provided on an suction side of the compressor 210.

The accumulator 250 separates the refrigerant, which has been discharged from the evaporator 240, into a gas-phase refrigerant and a liquid-phase refrigerant. The accumulator 250 sends the gas-phase refrigerant to the suction side of the compressor 210 and accumulates surplus refrigerant of the heat pump 200 therein.

The heat pump 200 further includes a blower 260 for blowing air (outside air) toward the evaporator 240. The blower 260 is capable of controlling the volume of air to be blown. The blower 260, the compressor 210 and the expansion valve 230 are controlled by an ECU (electronic control unit) 270 based on detection signals of various sensors 271 though 274.

A refrigerant temperature sensor 271 is provided to detect the temperature of the refrigerant discharging from the heat exchanger 40. A first water temperature sensor 272 is provided to detect the temperature of the service water flowing in the heat exchanger 40. A refrigerant pressure sensor 273 is provided to detect the pressure of the refrigerant (high pressure side refrigerant) discharging from the heat exchanger 40. A second water temperature sensor 274 is provided to detect the temperature of the hot water discharging from the water/refrigerant heat exchanger 40. The detection signals of the sensors 271 to 274 are inputted to the ECU 270.

Here, the high-pressure side refrigerant pressure is a pressure of the refrigerant flowing through a refrigerant passage from the discharge side of the compressor 210 to the inflow side of the expansion valve 230. The pressure is approximately equal to a discharge pressure of the compressor 210 and an internal pressure of the heat exchanger 40. On the other hand, a low-pressure side refrigerant pressure is a pressure of the refrigerant flowing through a refrigerant passage from the outflow side of the expansion valve 230 to the suction side of the compressor 210. The pressure is approximately equal to a suction pressure of the compressor 210 and an internal pressure of the evaporator 240.

An electric water pump (hereafter, referred to as a water pump) 400 is provided to supply and circulate the service water to the heat exchanger 40 while controlling the volume of the service water. A closed valve 410 is provided to restrict the service water from flowing from a service water pipe (not shown) into the heat exchanger 40. The water pump 400 and the closed valve 410 are controlled by the ECU 270.

Next, the heat exchanger 40 will be described in detail with reference to FIGS. 3A through 6. The heat exchanger 40 has a first tube 20 defining a passage (first fluid passage) through which the water (first fluid) flows and a second tube 10 defining a passage (second fluid passage) through which the refrigerant (second fluid) flows.

The first tube 20 has a rectangular flat box shape with a shallow depth. The box shape is produced by joining a first plate 21 and a second plate 22, which are formed by drawing of copper plates. Each of the first and second plates 21, 22 has a shallow box shape having an opening on one side. The first and second plates 21, 22 are formed with flanges on the peripheries of the openings to be joined with each other. The first tube 20 is formed with an inlet 23 at the periphery and an outlet 24 on a side opposite to the inlet 23 so that the water flows from the inlet 23 toward the outlet 24. At least one of the first plate 21 and the second plate 22 has a plurality of nail portions 48 on its peripheral end.

Figure 4:
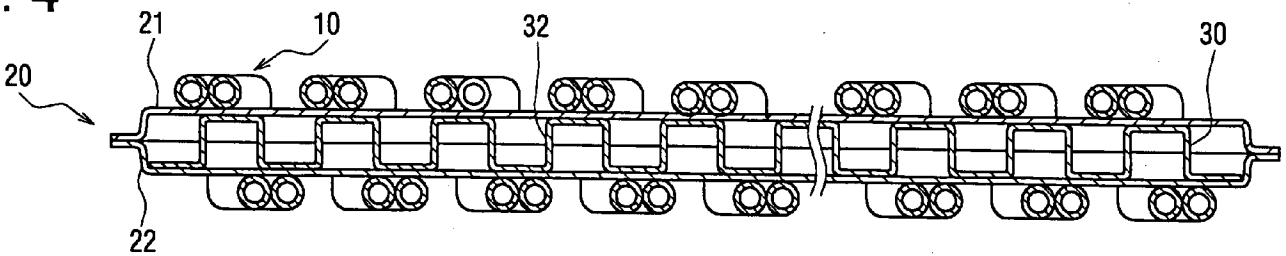
FIG. 4 is a cross-sectional view of the water/refrigerant heat exchanger taken along line IV—IV in FIG. 3A

The first tube 20 houses a corrugated plate 30 between the first plate 21 and the second plate 22. The corrugated plate 30 is made of a copper plate. The copper plate is bent into a series of alternate ridges and grooves in parallel lines. The top surfaces 31*b* of the ridges and bottom surfaces 31*a* of the grooves are flat. That is, the corrugated plate 30 is a plane type having a series of rectangular shaped cross-section, as shown in FIG. 4. The external size of the corrugated plate 30 (length, width, and height) is substantially equal to the inside dimension of the box shaped first tube 20 to be housed therein. The corrugated plate 30 further includes walls (intermediate walls) 32 (32*a*, 32*b*, 32*c*) between the ridges 31*b* and grooves 31*a* for partitioning the inside of the first tube 20 into a plurality of paths defining a serpentine flow.

Figure 5:
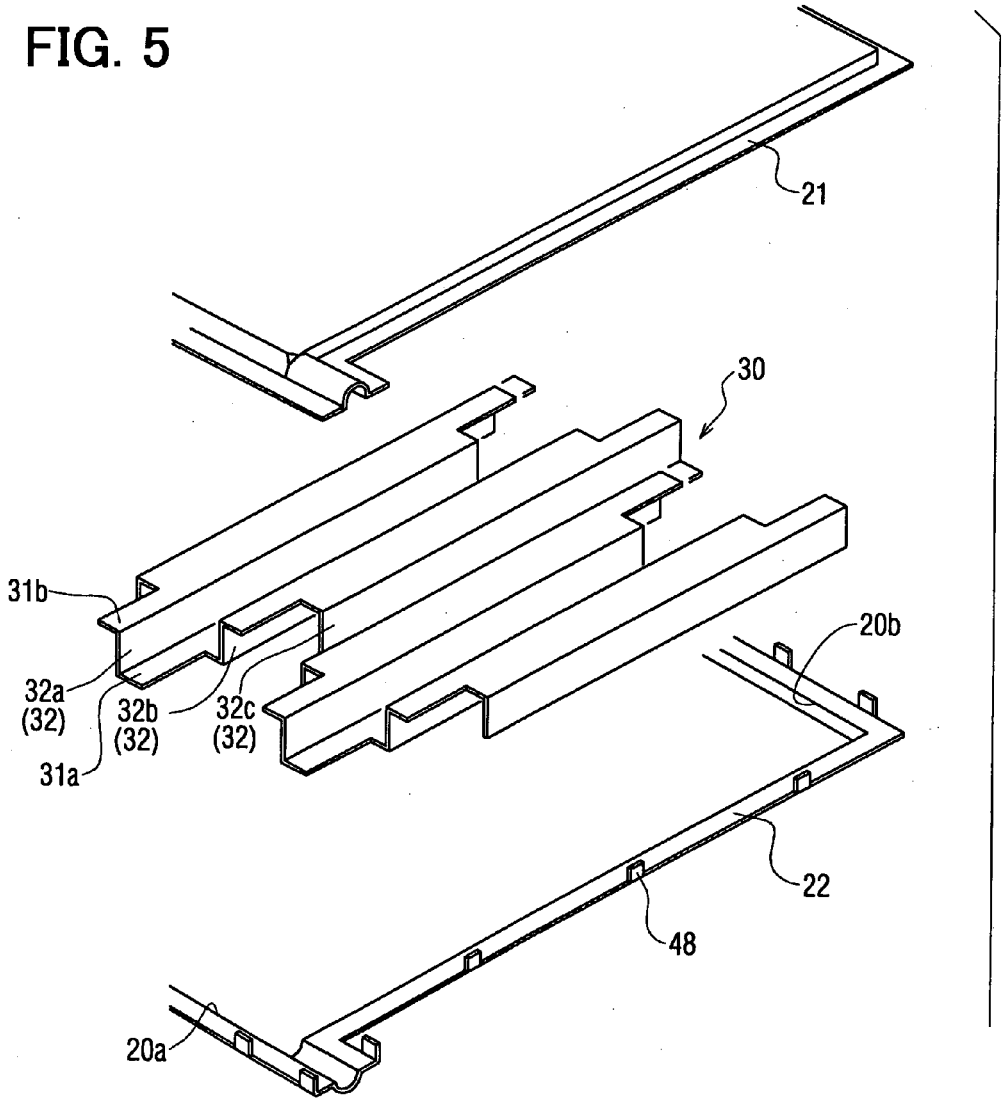
FIG. 5 is an exploded perspective view of a first tube of the water/refrigerant heat exchanger according to the embodiment of the present invention.
Figure 6:
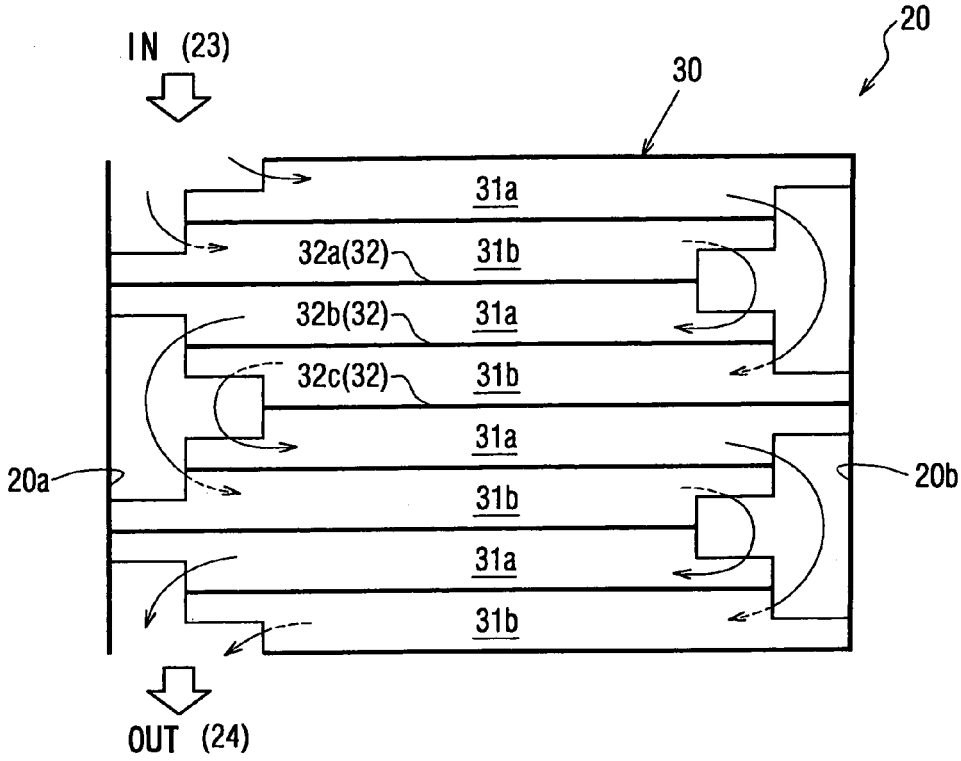
FIG. 6 is a schematic diagram for explaining a passage of water in the first tube according to the embodiment of the present invention.

Specifically, as shown in FIGS. 5 and 6, the walls 32, which connect the top surface 31*b* and the bottom surfaces 31*a*, includes first walls 32*a*, second walls 32*b* and third walls 32*c*. As shown in FIG. 6, each of the first walls 32*a* is disposed such that its first end (left end in FIG. 6) is proximate to a first inner side wall (left inner wall) 20*a* of the first tube 20 and its second end (right end in FIG. 6) is separate from a second inner side wall (right inner wall) 20*b* of the first tube 20 to define an opening between the second end and the right inner wall 20*b*. Each of the second walls 32*b* is disposed such that its first end (left end in FIG. 6) and its second end (right end in FIG. 6) are separate from the left inner wall 20*a* and right inner wall 20*b*, thereby defining openings on the first end and the second end. Each of the third walls 32*c* is disposed such that its first end (left end in FIG. 6) is separate from the left inner wall 20*a* to define an opening between itself and the left inner wall 20*a* and its second end (right end in FIG. 6) is proximate to the right inner wall 20*b*.

Further, the second end of the first wall 32*a* is farther from the right inner wall 20*b* of the first tube 20 than the second end of the second wall 32*b*. The first end of the third wall 32*c* is farther from the left inner wall 20*a* of the first tube 20 than the first end of the second wall 32*b*. The first walls 32*a*, the second walls 32*b* and the third walls 32*c* are reiteratively arranged in the order of the first wall 32*a*, the second wall 32*b*, the third wall 32*c* and the second wall 32*b*. Therefore, the corrugated plate 30 defines openings stepwise and alternately on the left side and the right side in the first tube 20.

The corrugated plate 30 is housed in the first tube 20 such that the top walls 31*b* and the bottom walls 31*a* are connected to the inner surfaces of the first plate 21 and the second plate 22.

Figure 3A:
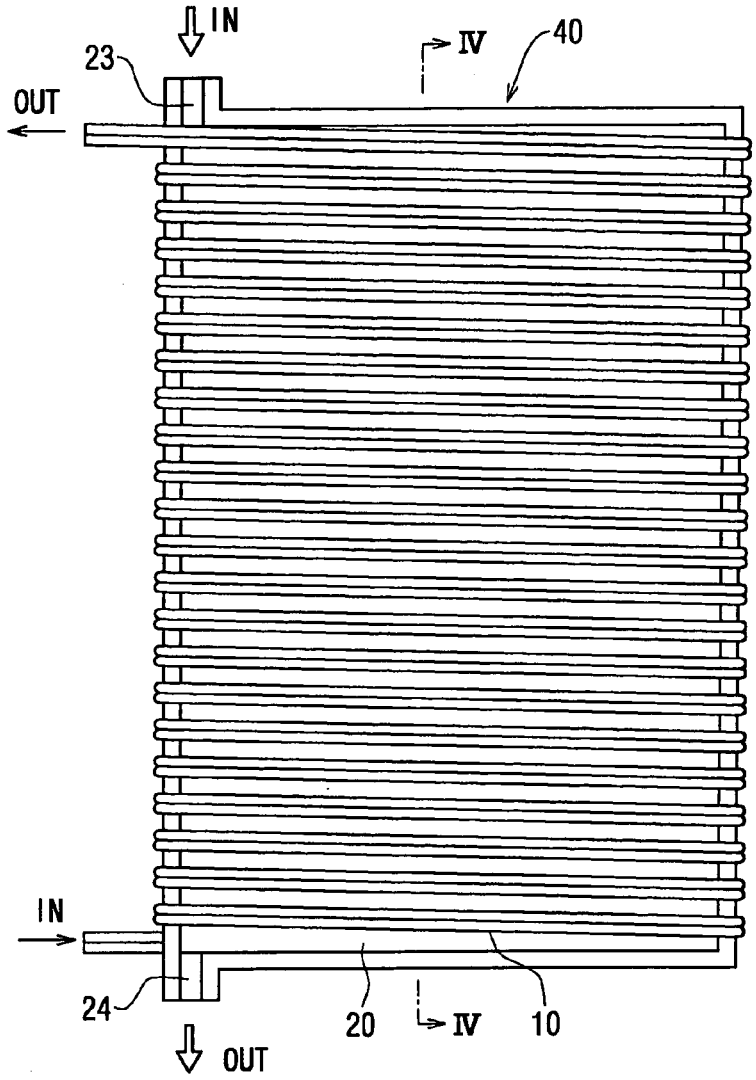
FIG. 3A is a plan view of a water/refrigerant heat exchanger according to the embodiment of the present invention.
Figure 3B:
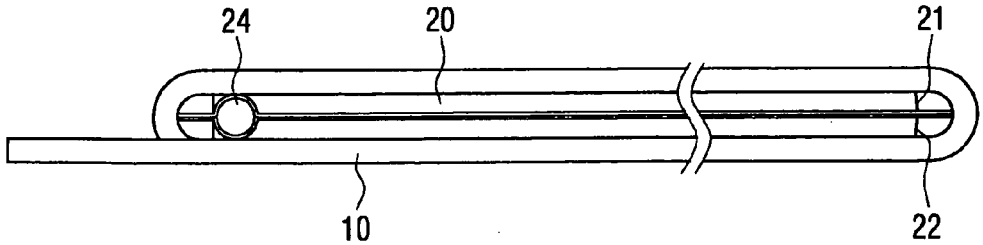
FIG. 3B is an end view of the water/refrigerant heat exchanger according to the embodiment of the present invention.

The second tube 10 is provided by two capillary pipes made of copper. The two pipes are arranged in parallel and close to each other, and are spirally wound around the outer periphery of the first tube 20, as shown in FIG. 3A. The pipes 10 are joined with the first tube 20 at the flat outer surfaces of the first plate 21 and the second plate 22.

In assembling the heat exchanger 40, first, the first plate 21 and the second plate 22 are joined at the flanges while interposing the corrugated plate 30 between them and temporarily fixed by the nail portions 48. Then, the second tube 10 is wound around the first tube 20 and a brazing material is placed on the respective joining surfaces. Thus, the heat exchanger 40 is temporarily assembled by using a predetermined jig. Next, the temporary assembled heat exchanger 40 is placed in a furnace, thereby integrally brazed.

According to the heat exchanger 40, the water passage (first fluid passage) is formed in the first tube 20 by the above described corrugated plate 30 as denoted by arrows in FIG. 6. The inside of the first tube 20 is partitioned by the walls 32*a* to 32*c* into a plurality of paths. The first walls 32*a*, the second walls 32*b*, and the third walls 32*c* are reiteratively arranged in the order of the first wall 32*a*, the second wall 32*b*, the third wall 32*c*, and the second wall 32*b*. Therefore, the ends of the walls 32*a* to 32*c* are regularly alternately displaced from the first and second inner side walls 20*a*, 20*b* of the first tube 20, thereby defining the openings. Accordingly, double-serpentine passage is formed from the inlet 23 to the outlet 24.

In the first tube 20, the water flows in a form of multiple-serpentine from the inlet 23 to the outlet 24. On the other hand, the high-pressure, high-temperature refrigerant flows through the second tube 10, which is spirally wound around the first tube 20. Thus, heat exchange is performed between the water and the refrigerant through the flat surfaces of the first and the second plates 21, 22. As a result, the water is heated and discharged from the outlet 24. Here, the intermediate walls 32*a*, 32*b*, 32*c* function as heat transferring fins.

Next, features of the embodiment will be described.

The corrugated plate 30 includes the first walls 32*a*, the second walls 32*b*, the third walls 32*c* reiteratively in the order of the first wall 32*a*, the second wall 32*b*, the third wall 32*c* and the second wall 32*b*. With this configuration, the water flows in and out a pair of paths through the openings defined by the ends of the second wall 32*b* at the same time, and further flows in a subsequent pair of paths through the openings defined by the first wall 32*a* or the third wall 32*c* at the same time while making U-turns. The water makes turns with a multiple-flow (double-flow in the embodiment), reducing the number of the turns.

In addition, as shown in FIG. 6, the second end of the first wall 32*a* is farther from the right inner wall 20*b* than the second end of the second wall 32*b*. The first end of the third wall 32*c* is farther from the left inner wall 20*a* than the first end of the second wall 32*b*. Therefore, each of the multiple flows makes alternately large turn having a large curvature and small turns having small curvature. This reduces the resistance of the fluid flow. Further, since the ends of the wall portions 32*a*, 32*b*, 32*c* are stepwise and alternately displaced from the inner side walls 20*a*, 20*b* of the first tube 20, the water is properly distributed to the plurality of passages. Thus, the flow of the water is uniformed.

Since the corrugated plate 30 is joined with the first plate 21 and the second plate 22 at the flat top surfaces 21*a* and the flat bottom surfaces 21*b*, the corrugated plate 30 is properly joined with the first plate 21 and the second plate 22. Further, this configuration increases an area of heat transfer surface, thereby improving heat transferring efficiency. The first fluid is the water and the second fluid is the refrigerant. Accordingly, the heat exchanger 40 is preferably used for the water/refrigerant heat exchanger for heating water by using the refrigerant, such as in the heat pump-type hot-water supply system.

Although the second tube 10 is spirally wound around the first tube 20, it is not limited this in the present invention. For example, two capillary pipes of the second tube 10 can be separated such that one of the pipes is arranged on the flat surface of the first plate 21 and the remaining pipe is arranged on the flat surface of the second plate 22 in the form of serpentine, respectively.

The heat exchanger 40 is employed as the water/refrigerant heat exchanger for the heat pump. However, the present invention can be employed to a heat exchanger for other purposes. Also, the first fluid and the second fluid are not limited to the water and the refrigerant.

The present invention should not be limited to the disclosed embodiments, but may be implemented in other ways without departing from the spirit of the invention.

What is claimed is:

1. A heat exchanger comprising:

a first tube defining therein a first passage through which a first fluid flows, the first tube having a first inner side wall and a second inner side wall opposite to each other;

a second tube defining therein a second passage through which a second fluid flows, the second tube being joined to an outer surface of the first tube for performing heat exchange between the first fluid and the second fluid; and a corrugated plate housed in the first tube, wherein the corrugated plate has intermediate walls for partitioning the first passage, the intermediate walls include first walls, second walls, and third walls, each defining a first end and a second end opposite to each other, each of the first walls is disposed such that the first end is proximate to the first inner side wall of the first tube and the second end defines an opening between itself and the second inner side wall of the first tube, each of the second walls is disposed such that the first end and the second end are separate from the first inner side wall and the second inner side wall of the first tube for defining openings, each of the third walls is disposed such that the first end defines an opening between itself and the first inner side wall of the first tube and the second end is proximate to the second inner side wall of the first tube, and the first walls, the second walls, and the third walls are reiterative in an order of the first wall, the second wall, the third wall and the second wall.

2. The heat exchanger according to claim 1, wherein the intermediate walls connects ridges and grooves of the corrugated plate, and the ridges and the grooves includes flat surfaces.

3. The heat exchanger according to claim 1, wherein the first fluid is water and the second fluid is refrigerant.

4. The heat exchanger according to claim 1, wherein the first tube further defines an inlet through which the first fluid flows in and an outlet through which the first fluid flows out, the first tube has a rectangular flat box shape constructed by joining a first plate and a second plate, which are produced by drawing, at the peripheries thereof, the corrugated plate has ridges and grooves each including flat surfaces, and the flat surfaces are connected to inside walls of the first and second plates.

5. The heat exchanger according to claim 1, wherein the second tube is constructed of a plurality of capillary pipes, and the capillary pipes are spirally wound around the first tube in parallel to one another.

6. The heat exchanger according to claim 1, wherein the second end of the first wall is separate farther from the second inner side wall of the first tube than the second end of the second wall, and the first end of the third wall is separate farther from the first inner side wall of the first tube than the first end of the second wall.

7. A heat exchanger comprising:

a tube defining therein an inside fluid passage through which an inside fluid flows, wherein the tube defines a first inner side wall and a second inner side wall opposite to each other; and a corrugated plate defining ridges and grooves, wherein the corrugated plate is disposed in the tube so that the inside fluid passage defines a plurality of paths by intermediate walls of the corrugated plate that connect the ridges and the grooves, each of the intermediate walls defines a first end and a second end opposite to each other, the intermediate wall that is located between a pair of paths defines openings between the first end and the first inner side wall of the tube and between the second end and the second inner side wall of the tube for allowing the pair of paths to communicate with each other, and the intermediate wall that is located between the pair of paths and a subsequent pair of paths defines one of a first opening between the first end and the first inner side wall of the tube and a second opening between the second end and the second inner side wall of the tube for allowing the two pairs of paths to communicate with each other, thereby allowing the inside fluid to flow in and out the pair of paths and further flow in the subsequent pair of paths at the same time through the openings.

8. The heat exchanger according to claim 7, wherein the intermediate walls that are located between the two pairs of paths alternately defines the first opening and the second opening with respect to the flow of the inside fluid.

* * * * *